US006358009B1

(12) United States Patent
Link

(10) Patent No.: US 6,358,009 B1
(45) Date of Patent: Mar. 19, 2002

(54) FAN BLADE ASSEMBLY AND METHOD OF BALANCING THE SAME

(75) Inventor: Larry Ray Link, Frankfort, IL (US)

(73) Assignee: American Cooling Systems, LLC, Grand Rapids, MI (US)

( * ) Notice: Subject to any disclaimer, the term of this patent is extended or adjusted under 35 U.S.C. 154(b) by 0 days.

(21) Appl. No.: 09/475,925

(22) Filed: Dec. 30, 1999

(51) Int. Cl.[7] ..... F04D 29/00

(52) U.S. Cl. ..... 416/145; 416/146 R; 416/169 R; 416/189; 416/170 R; 416/241 A; 416/500

(58) Field of Search ..... 416/145, 144, 416/146 R, 169 R, 189, 170 R, 241 R, 241 A, 500

(56) References Cited

U.S. PATENT DOCUMENTS

| | | | | | |
|---|---|---|---|---|---|
| 2,108,624 | A | * | 2/1938 | Thearle | 73/445 |
| 2,336,697 | A | * | 12/1943 | Moeller | 416/144 |
| 3,315,750 | A | * | 4/1967 | Delaney | 416/144 |
| 3,782,202 | A | * | 1/1974 | Anderson et al. | 73/445 |
| 4,107,257 | A | * | 8/1978 | Swin, Sr. | 264/328 |
| 5,591,008 | A | * | 1/1997 | Wrobel et al. | 416/144 |
| 5,988,978 | A | * | 11/1999 | Pearce | 416/145 |
| 6,123,051 | A | * | 9/2000 | Kubina et al. | 123/41.49 |

FOREIGN PATENT DOCUMENTS

| | | | |
|---|---|---|---|
| JP | 10151413 A | * | 6/1998 |

* cited by examiner

*Primary Examiner*—Edward K. Look
*Assistant Examiner*—Ninh Nguyen
(74) *Attorney, Agent, or Firm*—Fitch, Even, Tabin & Flannery

(57) ABSTRACT

A method and apparatus are used to balance an open blade fan of the kind used with trucks, diesel engine driven generator sets, and the like. An apparatus is used to spin the fans and a vibration sensor senses vibrations and a light beam is used to indicate the location to attach a balancing weight. The fan is spun again and the vibrations measured and additional weights are attached at different specified locations until the measured vibrations are below a predetermined level. The fan includes a plastic body with integral, plastic fan blades which is attached to a central metal hub plate with configured weights attached to matching configured portions of the plastic body. The preferred weights are clips with barbs that pierce the plastic body. The metal hub plates are electrostatically painted to provide a uniformly thick coating with good adhesion. An ultraviolet light additive is provided in the plastic body with the fan blades being reinforced with glass particles and rendered UV resistant by the UV additive.

24 Claims, 3 Drawing Sheets

FAN BLADE ASSEMBLY AND METHOD OF BALANCING THE SAME

FIELD OF THE INVENTION

This invention relates to an open blade fan for use with a fan clutch such as used in diesel powered trucks, stationary generator sets, etc., and to a method of balancing and to making same.

New emissions standards in Europe and new emission standards to become effective in the year 2002 in the United States require substantial reduction in emissions of hydrocarbons from diesel engines. Current proposals and modifications to diesel engines involve running the diesel engines at higher operating temperatures to reduce emissions. Thus, a greater amount of heat is generated by these diesel engines and this necessitates a greater air flow across the radiator to drop the radiator liquid temperature. Usually, manufacturer specifications specify for a given diesel engine application the volume of air flow needed to drop the cooling liquid's temperature 1° C. across the radiator at given conditions. In some instances, the current open blade fans may be using as much as 60 HP at 2400 rpm to generate about 20,000 cfm to cool engines operating at the current diesel engine temperature conditions. For the newer and hotter temperature engines, the air flow requirement may be as much as 35,000 cfm rather than 2400 cfm for the same truck, diesel generator sets, etc.

A typical approach in the prior art is to use the same fan and to run it at a higher speed than 2400 rpm to obtain the desired 35,000 cfm; but increase of fan speed requires an increase in horsepower and generates more noise. Of course, operating at substantially higher speeds often results in requiring greater strength for the fan to withstand higher forces and stresses because of spinning the fan mass at higher speed. There is a need to balance such fans so that they do not vibrate excessively while spinning.

Open blade fans used with fan clutches are subject to deterioration and a shorter life if they are not properly balanced. Because a truck fan is being driven at high rotational speeds and may be driven by an engine in a truck that may be bouncing over a rough highway, the fan is subject to various forces and vibrations that add stress to the rotating fan blades. Particularly, plastic fan blades being subjected to high ambient heat, as in desert areas and high engine heat outputs beneath a truck hood, can deteriorate and have a shorter life if subjected to high stresses due to vibrations caused by the fan being out of balance. Conversely in very cold, frigid climates and in winter, the plastic of the plastic fan blades tends to become more brittle and it is undesirable to stress these fan blades with high stresses due to fan blade vibration from out-of-balance fan blades.

One conventional manner of balancing open fan blade types of fans having plastic blades is to sever a piece of a fan blade plastic and then spin the fan and observe whether or not there is an improvement in ran balance. If the first saw cut of plastic failed to achieve the desired cut, then a second cut of plastic is made. Obviously, such a trial-and-error method of balancing a fan requires a skilled operator and is very subjective. A shortcoming of cutting plastic from fan blade tips in order to balance the fan blade rotation is that the shortened blade has a greater clearance with the surrounding shroud. From a fan efficiency standpoint, it is undesirable to increase the distance between the fan blade tip and the shroud housing.

Another prior method of balancing plastic fans of this type was to locate the center of balance in a central metal hub plate which is located at the center or hub of the fan and to which the plastic fan blades are attached. Having located the center of balance on the metal hub plate, a new mounting hole can be made at this center of balance and a circular series of bolt-receiving holes can be made about the newly-centered hole to locate the fan rotational axis at the center of the new central mounting hole. Such a secondary operation is time consuming and expensive, and results in fan blade tips that are not equally spaced from the rotational axis thereby increasing the distance between the shortest fan blade tip from the shroud with a concomitant decrease in fan efficiency.

Another problem with plastic, open blade fans of this kind having a central metal plate is the use of electro-plating techniques to coat the central metal hub plated with a corrosion-resistant coating. It has been found that electro-plated coats may be uneven with heavy plate areas and lightly plated areas. Thus, the lightly coated areas are subject to corroding particularly in bad corrosive environments to which a truck or generator fan may be exposed. Also, these heavy spots and lighter spots of corrosion-resistance coating tend to throw the fan off balance. Some fan blades are spray painted with uneven coats of paint that also allow corrosion at lightly coated areas. Uneven paint coatings may also add to the fan balancing problem. Thus, there is a need for a new and improved manner of coating the metal fan hub plates that provide an improved, more uniform coating to resist corrosion and that also doesn't add to the fan balancing problem.

Additionally, it has been found that, in some instances, fan blade deterioration may have been due to exposure of the plastic blades to ultra-violet light from sun rays. For example, if the plastic fan blades are used in a generator set in a very sunny desert location, the plastic of current fan blades may be adversely affected by prolonged exposure to high-intensity UV light. Thus, there is a need to provide a UV plastic fan for use in such environments.

SUMMARY OF THE INVENTION

In accordance with the present invention, there is provided, as contrasted with the prior art, a new and improved plastic, open blade fan for use with trucks, diesel engine driven generator sets, etc. In accordance with another important aspect of the invention, an open blade, plastic fan is balanced with a new and improved method that comprises a spinning of the fan blade about its rotational axis and sensing vibrations from the spinning fan; stopping rotation of the fan; specifying locations on the plastic fan body to receive a clip weight; and attaching the clip weight to the plastic body at the specified locations, preferably by clipping of the clip weight to the plastic of the plastic fan body. Preferably, the method includes the providing of clip weights with integral barbs, hooks, or the like, that can be pushed into the plastic with barbs or hooks resisting a throwing off of the weights at high rotational speeds of the fan. In this illustrated and described embodiment of the invention, the fan body is provided with a circular array of integral molded ribs and metal channel-shaped clip weights are pushed over the ribs at the selected locations with integral barbs on the channel-shape clip weights piercing the plastic of the ribs. Herein, the plastic ribs have an outer contour, such as a rounded surface, and the weights have a complimentary shape to allow intimate contact across substantially an entire, inner concave surface of the channel-shaped clip and the outer, convex, rounded surface of the plastic rib. This helps in balancing and in retention of the clip weights on the ribs at high rotational speeds of the fan.

In accordance with another aspect of the invention, the metal hub plate of the plastic fan is provided with an improved corrosion-resistant coating and a more uniform thickness of coating for assisting in the balancing of the fan. This is achieved by using an electrostatic spray coating of the metal plate with a substantially uniform, electrical charge on the metal plate to attract the coating particles to the plate in a uniform manner that results in a more uniform thickness of coating on the metal plate. The preferred coating is an electrostatic paint. This eliminates thinly coated areas that allow corrosion, good adhesion of the paint to the metal, and a balanced uniformly thick coating that assists in the balancing of the fan. The metal plates are electrostatically painted before being molded in situ with the plastic fan body.

In accordance with the preferred embodiment of the invention, the fan body is made of plastic that has improved resistance to deterioration by UV light from sunlight. This is achieved by adding to the plastic a UV addition prior to molding the fan blades and the fan blade body. That is, the preferred UV additive is blended into the bulk plastic by the plastic suppliers. Herein, the preferred UV fan blades are made of nylon that is reinforced by glass particles and rendered UV-resistant by a UV additive to the plastic.

DETAILED DESCRIPTION OF THE PREFERRED EMBODIMENTS

Figure 1:
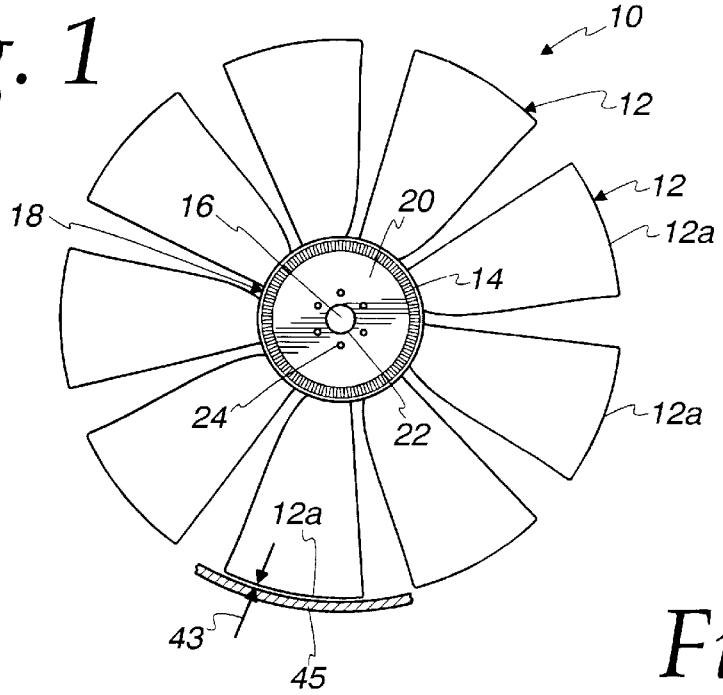
FIG. 1 is a perspective view of a fan blade assembly embodying the invention.
Figure 2:
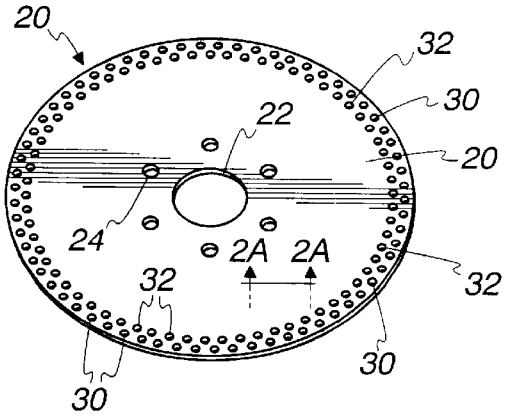
FIG. 2 is a perspective view of a metal hub plated used in the fan blade assembly of FIG. 1.

As shown in the drawings for purposes of illustrations the invention is embodied in a fan blade assembly 10 (FIG. 1) having a plurality of fan blades 12 projecting radially outwardly from a central hub 14, which is located at a rotational axis 16 for the fan assembly. Herein, the illustrated fan is used on large trucks or diesel generator sets for moving substantial volumes of air to cooling the engine. The illustrated fan blade assembly has a plastic body 18 in which is molded, in situ, a steel hub plate 20 located at the central hub base of the fan blade assembly and having a central mounting opening or hole 22. A plurality of bolt receiving holes 24 encircle the central hole 22 to allow the fan to be secured as by bolts to a driver such as an on/off clutch. The preferred hub plate is configured to be connected to the plastic body to resist separation therefrom when spinning the fan blade assembly at high speed. To this end, the hub plates, which is shown in FIG. 2, has an outer series of small holes 30 and inner series of small holes 32 into which liquid plastic is introduced during the molding of the plastic body which, upon curing, results in small cylindrical pieces of plastic extending through the holes to unite the plastic fan body and hub plate without the use of fasteners and with plastic on both sides of the metal plate at a plastic hub piece 18*a* of the plastic fan body 18.

Figure 3:
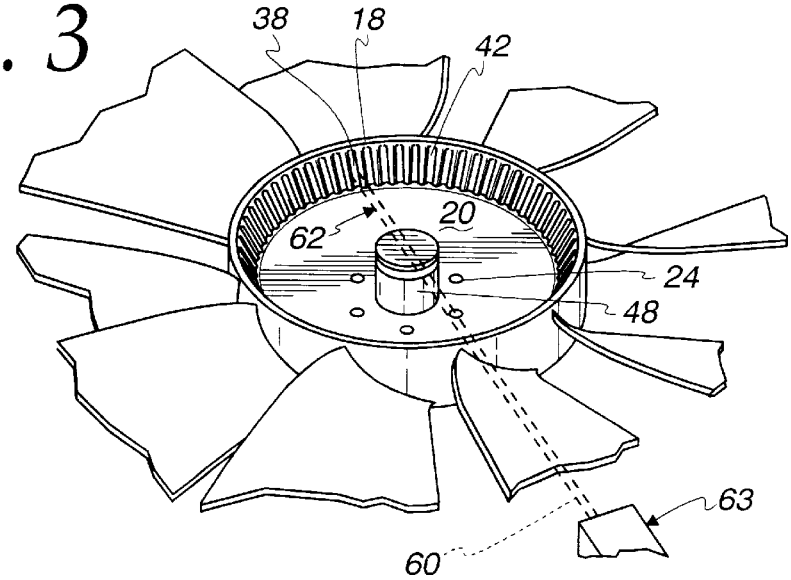
FIG. 3 is a diagrammatic view of a laser light beam locating spots to attach weights in order to balance the fan blade assembly.
Figure 4:
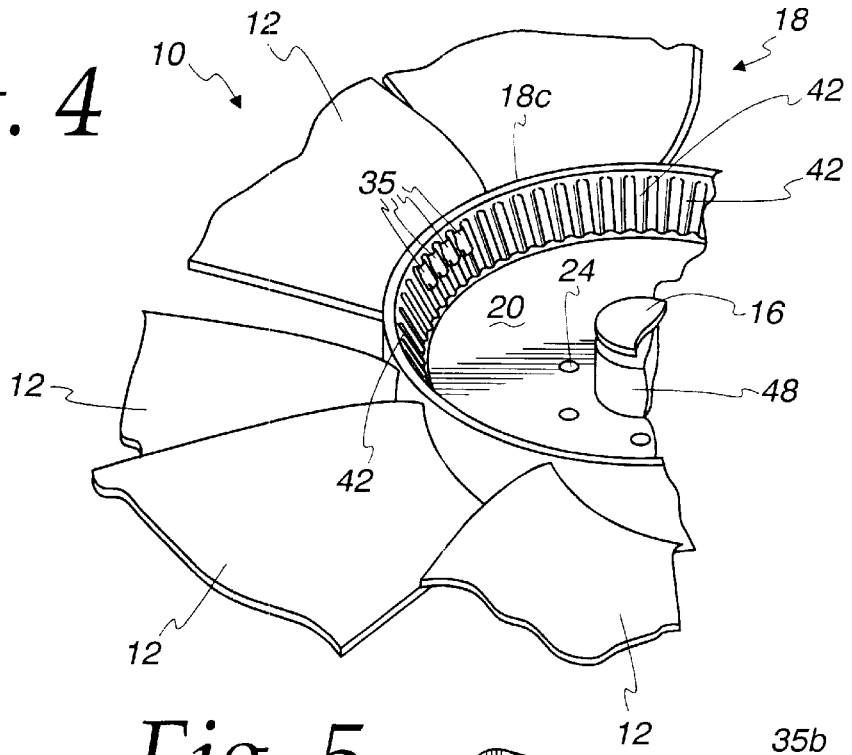
FIG. 4 is an enlarged, fragmentary view of clip weights attached to ribs on the fan blade assembly to balance the latter.
Figure 5:
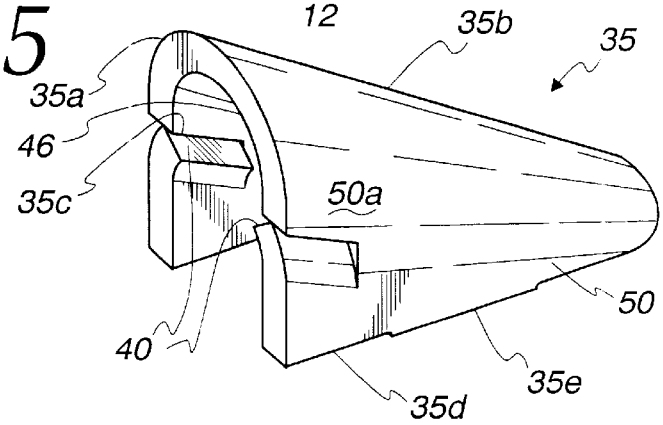
FIG. 5 is a perspective view of a preferred clip weight.
Figure 6:
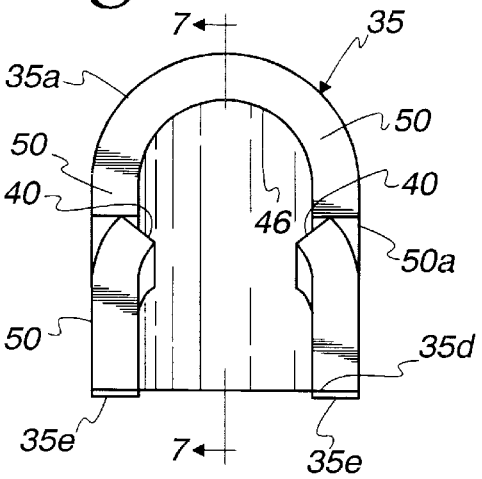
FIG. 6 is a side elevational view of the weight clip of FIG. 5.

In accordance with the present invention, a new and improved method of balancing the fan blade assembly comprises spinning the fan blade about its rotational axis 16 and sensing vibrations from the spinning fan and then stopping rotation of the fan; specifying locations on the plastic fan body to receive clip weight 35 (FIGS. 4 and 5); and attaching the clip weight 35 to the plastic body at the specified locations 38 (FIG. 3). The preferred method of attaching the clip weights 35 to the body comprises a clipping of the weights to the plastic by pushing integral barbs 40 (FIGS. 5–8) on the metal weights into the plastic body so that the barbs resisting a throwing off of the weights at high rotational speeds of the fan.

In accordance with the present invention, each of the fan blades 12 has its outer radial edge or tip 12*a* spaced radially from the central rotational axis 16 at equal distances or lengths when the fan has been balanced with the weights 35. This is in contrast to the prior art method of trimming the blade tips to balance the fan. The use of the weights allows each of the fan blades to have the same radial clearance distance 43 (FIG. 1) with an encircling, conventional shroud 45 which surrounds the fan blades. In the prior art technique of clipping the blade ends, the radial clearance distance 43 will be larger for the clipped blades than for the unclipped blades. In other described method of balancing the fan blade assembly, the center of balance (not shown) was located for each fan assembly and a mounting hole (22) was made at this center of balance, but this center of balance axis of the new mounting hole was offset from a central physical axis defined by the intersection of radial lines through the fan blades. Thus, the center-of-balance axis in the metal plate is eccentric to an imaginary axis for the plastic fan blades from which the tips of the fan blades are equally spaced. With the mounting hole at the center of balance, which is eccentric to the imaginary axis for the blade tips, the blade tips will be spaced at unequal distances from the shroud. In the present invention, the clearance distance 43 is kept very small to increase air flow efficiency with the clearance space being substantially equal for each fan blade, which is not true for the above-described balancing methods.

Figure 10:
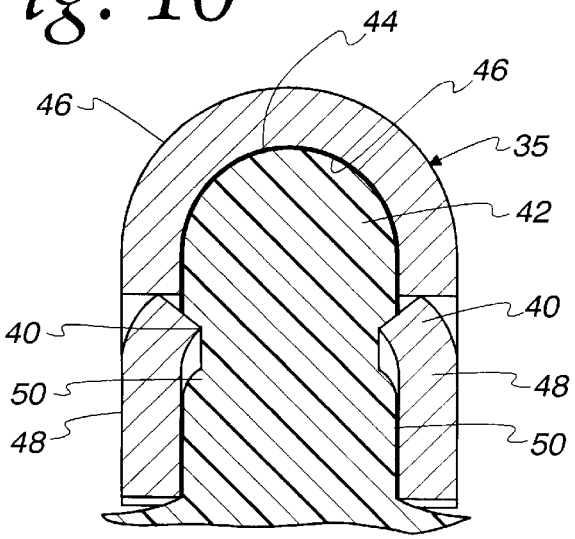
FIG. 10 is a cross-sectional view taken through a channel-shaped weight clipped to a plastic, rounded rib on the fan blade assembly.

In the preferred method, the fan body is provided with integral molded portions shaped to receive the clip weights 35 in the form of integral ribs 42. Herein, the ribs 42 have an outer contour, such as a rounded surface 44 (FIG. 10) and the clip weights 35 are channel-shaped with an interior surface 46 that is rounded to engage intimately the similarly radiused, curved rib surface 44. That is, the channel-shaped, clip weight has an inner concave surface 46 mated to the outer convex, rounded surface 44 of the plastic rib. The plastic ribs also have a pair of substantially parallel side-walls 48 on opposite sides of the outer rounded surface 44 and the channel-shaped clip weight has a pair of parallel sidewalls 50 that are abutted against these rib sidewalls 48.

Figure 7:
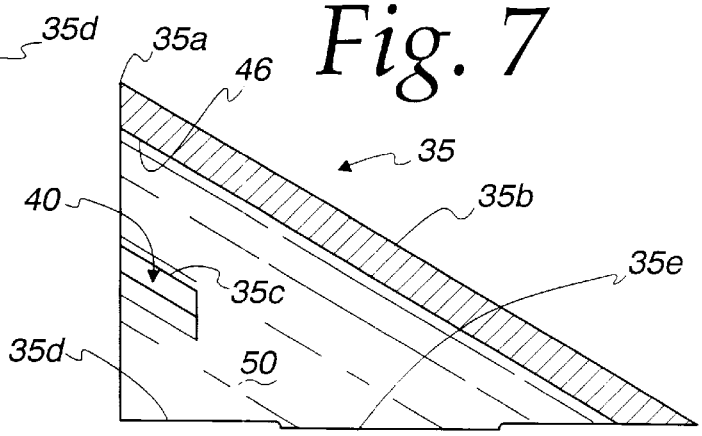
FIG. 7 is a side view of the weight clip.
Figure 8:
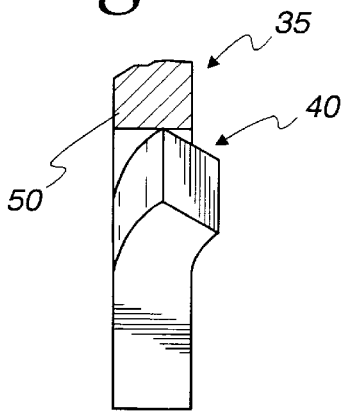
FIG. 8 is an enlarged cross-sectional view showing the integral barbs on the clip weights.

The illustrated and preferred clip weights 35 are formed of metal such as steel and have a predetermined weight. By way of example only, one preferred weight clip is about one inch in length and about 0.525 inch in height at upper end 35*a* and an inclined web or top wall 35*b* inclined at 23° to the horizontal. The width is about 0.36 inch between the outer vertical surface 50*a* of the parallel legs 50. The steel stock size is about 0.040 inch in thickness. The weight of this clip is 61 grains. A smaller size clip is about 0.560 inch in length and has a height of 0.400 inch at the upper end 35*a*. The length of the top wall 35*b* is 0.69 inch in this instance. It measures about 0.25 inch between the outer vertical surface 50*a* of its parallel legs 50. The steel stock size 0.050 inch and the barb has its point located 0.075 inch from the outer vertical surface 50*a* of the leg from which it is upstruck. The barbs are upstruck about a line 35*c* inclined and parallel to the top wall, as best seen in FIG. 7. Manifestly, the size, weight and shape of the weights 35 may be varied from those illustrated and described herein. The lower edges 35*d* of the clip weights 35 may be provided with small pieces 35*e* to puncture into the plastic fan body to resist for or aft sliding of the clip weight. Herein, the puncture pieces 35*e* are about 0.250 inch in width and project downwardly about 0.010 inch from the lower edge 35*d*. Manifestly, the size, shape and location of nieces to penetrate the plastic may be varied from that described herein and fall within the scope of the invention. More than one weight may be attached to the series of ribs 42; there being six weights 35 attached to six consecutive ribs 42 on the fan body shown in FIG. 4. Often the clip weights are spaced from one another with one or more ribs having no weights thereon between other ribs having weights thereon.

Figure 9:
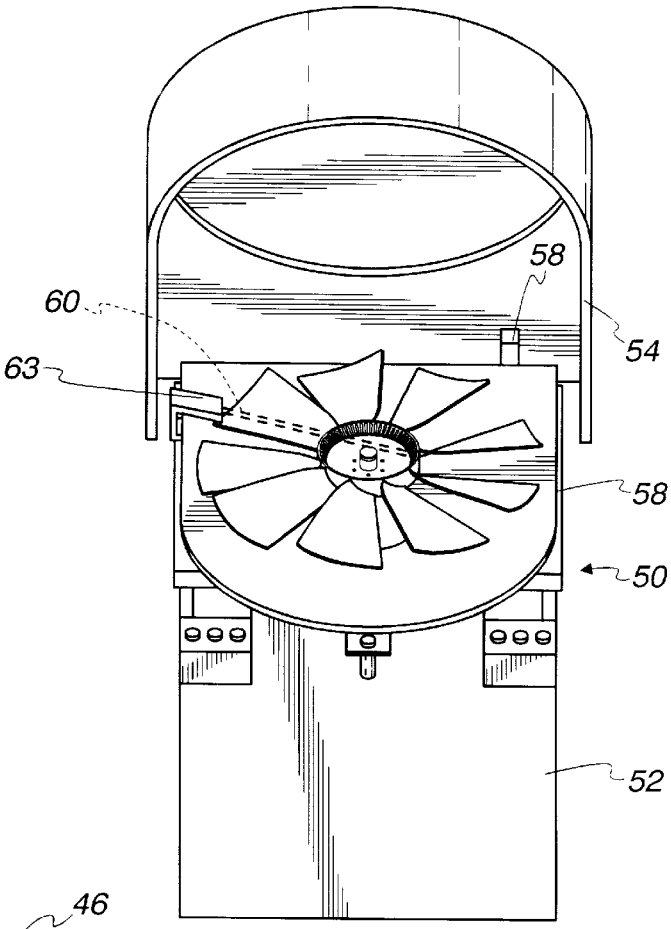
FIG. 9 is a perspective view of the fan blade, spinning machine.

In the preferred method, the fan blade assembly 10 is mounted on a rotational hub 48 (FIG. 3) of a spinning machine 50 (FIG. 9) that has a frame and housing 52 in which is disposed a motor and controls for spinning the driving hub 48 and attached fan at the selected rotational speed. A clear plastic cover 54 is pivotally mounted on the machine to allow positioning of a fan blade assembly 10 on the hub and removal of the fan blade assembly after specifying rib locations to receive the clips. A vibration sensor 58 on the machine senses vibrations on the rotating fan blade body 10 and an indicator 60 (FIGS. 3 and 9) such as a laser light beam 62 (FIG. 3) specifies the location 38 and rib 42 to receive a weight clip. The illustrated machine has a laser beam generator 63 (FIGS. 3 and 4) which emits the laser beam 62 to locate a rib 42 on the hub while the fan blade assembly is stationary and mounted in the machine. The fan blade assembly may have to be spun several times and then stopped and another weight clip attached at a newly located rib at the end of each spinning cycle. When the vibration sensor 45 no longer senses a predetermined amount of vibrations being present in the spinning fan, then the balancing and spinning is terminated. The vibration sensor and laser light beam indicator are known technology and the illustrated machine is commercially available from Ravens Engineering.

By way of example only, the fan blade assemblies 10 described herein range in size from 24 inches to 38 inches in diameter and come with 6, 7, 8, 9 or 10 blades (12) and run at various rpm up to a maximum of 2400 rpm. Typically, the fan volume ranges in 20,000 cfm to 35,000 cfm and are driven using a maximum of about 45 to 60 horsepower from the diesel motor drive.

Figure 2A:
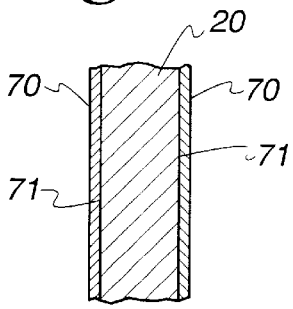
FIG. 2A is a cross-sectional view taken along the line 2A—2A of FIG. 1 showing a uniform coating on opposite sides of the metal plate.

In accordance with an important aspect of the invention, the central metal plate 20 is provided with a very even, corrosion-resistant coating 70 (FIG. 2A) on opposite faces 71 of the metal plate. This is achieved by electrostatically spray painting the metal plate with charged particles of paint that are electrically charged opposite to the charge on the metal plate. This positive and negative charge relationship controls the thickness of the coating and the coating of the metal plate uniformly across the entire faces 71 of the metal plate. In contrast thereto, the usual coating techniques involving non-electrostatic painting or involving the use of electro-plating techniques leave uneven coats with heavy plated areas and lightly plated areas on the plate surface 71.

The non-uniform coating of the conventional techniques used heretofore and the resulting heavy and light spots of coating resulted in an off-balance of the fan adding to the balancing problem.

In accordance with another important aspect of the invention, the plastic fan blade assembly 10 has enhanced resistance to deterioration due to exposure to sunlight, particularly the UV rays in sunlight. In addition to being used in vehicles such as trucks, these fan blade assemblies 10 are often used with heavy construction equipment and diesel electric generator sets to cool the liquid in the radiators of such equipment and generators of electricity. To this end, the plastic material, which is preferably nylon filled with about 30% glass to provide additional strength, has added thereto a UV additive. That is, the producer of the bulk plastic, in this instance BASF Corporation, located in New York, U.S.A., adds the UV additive and blends it into the nylon and glass bulk plastic which is then shipped to the fan molder who then molds the fan blade assembly 10. Thus, the blades and plastic hub are UV resistant when exposed to sunlight. In deserts or other hot areas, the plastic fan blade assembly may have prolonged exposure to intense sunlight and hence exposed to considerable UV light waves.

From the foregoing, it will be seen that there is a new and improved fan blade assembly that is balanced by an improved balancing method and by attached weights. The use of a spinning technique and clipping of weights to plastic portions shaped to receive the weights provide a less expensive and better way to balance the fan blade assembly. The use of an electrostatic application of coating to the metal plate hub results in a uniform coating on both sides of the metal plate. The preferred coating is a paint that is uniform in thickness across both sides of the metal plate to assist in balancing the spinning fan assembly and to provide uniform protection over the entire metal plate to corrosive elements being applied to fan during its life. Also, in accordance with the invention, the plastic of the fan blade assembly has a UV additive therein to resist deterioration due to prolonged exposure to sunlight and UV wave length rays in the sunlight.

It will be appreciated that although various aspects of the invention have been described with respect to specific embodiments, alternatives and modifications will be apparent from the present disclosure, which are within the spirit and scope of the present invention as set forth in the following claims.

What I claim is:

1. A balanced open fan for use with a fan clutch comprising:

a fan body made at least partially of plastic and rotatable about a central axis through the fan body;

a central hub on the fan body having a central opening at the rotational axis to attach a fan clutch;

a plurality of plastic fan blades extending radially outwardly from the central hub and rotatable about the central axis;

balancing weights fastened to the fan body to balance the fan body in its rotation about the central axis; and the balancing weights comprising clips that are clipped onto the fan body.

2. A balanced open fan for use with a fan clutch comprising:

a fan body made at least partially of plastic and rotatable about a central axis through the fan body;

a central hub on the fan body having a central opening at the rotational axis to attach a fan clutch;

a plurality of plastic fan blades extending radially outwardly from the central hub and rotatable about the central axis;

balancing weights fastened to the fan body to balance the fan body in its rotation about the central axis; and a circular array of ribs being formed on the fan body and the balancing weights are selectively secured to some of the ribs to balance the fan for rotation about the central axis.

3. A balanced open fan in accordance with claim 2, wherein the balancing weights comprise clips that are clipped to some of the ribs.

4. A balanced open fan in accordance with claim 3, wherein the clips have barbed hooks which are forced into the plastic ribs to secure the clips to the rib.

5. A balanced open fan in accordance with claim 3, wherein the ribs have outer, rounded surfaces and the clips have a mating rounded surface to fit snugly against the clip's rounded surface.

6. A balanced open fan for use with a fan clutch comprising:

a fan body made at least partially of plastic and rotatable about a central axis through the fan body;

a central hub on the fan body having a central opening at the rotational axis to attach a fan clutch;

a plurality of plastic fan blades extending radially outwardly from the central hub and rotatable about the central axis;

balancing weights fastened to the fan body to balance the fan body in its rotation about the central axis;

the weights comprising metal clips having a pair of parallel flanges and a central arcuate web joining the parallel flanges to produce a channel-shaped clip; and integral barbs on the clips for piercing the plastic when being applied and for resisting flying off the fan under centrifugal force when the fan is rotating at high speeds.

7. A balanced open fan for use with a fan clutch comprising:

a fan body made at least partially of plastic and rotatable about a central axis through the fan body;

a central hub on the fan body having a central opening at the rotational axis to attach a fan clutch;

a plurality of plastic fan blades extending radially outwardly from the central hub and rotatable about the central axis;

balancing weights fastened to the fan body to balance the fan body in its rotation about the central axis;

the fan comprising a central metal plate with openings therein;

the plastic fan body having portions integrally molded into the openings on the central metal plate with central metal plate being molded, in situ, in the plastic fan body; and an electrostatic spray paint coating on the metal plate to reduce corrosion of the plate.

8. A fan in accordance with claim 7, wherein the electrostatic spray paint coating has a substantially uniform coating to assist in balancing the fan.

9. A balanced open fan for use with a fan clutch comprising:

a fan body made at least partially of plastic and rotatable about a central axis through the fan body;

a central hub on the fan body having a central opening at the rotational axis to attach a fan clutch;

a plurality of plastic fan blades extending radially outwardly from the central hub and rotatable about the central axis;

balancing weights fastened to the fan body to balance the fan body in its rotation about the central axis; and wherein the plastic of the plastic body contains an anti-ultraviolet additive to make the plastic fan body more resistant to deterioration when exposed to sunlight.

10. A balanced open fan assembly for use with a fan clutch comprising:

a fan body made at least partially of plastic and rotatable about a central rotational axis through the fan body;

a central hub on the fan body having a central opening at the rotational axis to attach a fan clutch;

a plurality of plastic fan blades extending radially outwardly from the central hub and rotatable about the central axis;

balancing weights fastened to the fan body to balance the fan body in its rotation about the central axis;

each of the fan blades having an outer tip located at substantially identical lengths in the radial direction from the central rotational axis, the tips being untrimmed;

the central opening in the hub being concentric with the plastic fan blade tips;

an encircling shroud spaced circumferentially about the fan blade tips and concentric with the central rotational axis to provide a substantially uniform tight tip clearance with each of the untrimmed fan blades;

a series of plastic ribs on the fan body being concentrically located about the central, rotational axis of the fan body; and the balancing weights comprising clips that are clipped to one or more of the ribs to balance the fan body within the surrounding shroud.

11. A method of balancing an open fan having a plastic body having plastic fan blades rotatable about a central rotational axis, the method comprising:

spinning the fan about its rotational axis and sensing vibrations from the spinning fan;

using an apparatus having vibration sensor to sense the amount of vibration in the spinning fan;

stopping rotation of the fan;

using a light beam of the apparatus to specify a location on the plastic fan body to receive a balancing weight;

attaching the balancing weight to the plastic body at the specified location to balance the fan;

spinning the fan again with a balancing weight thereon and using the vibration sensor of the apparatus to sense the vibrations, again stopping the fan spinning and using the light beam of the apparatus to specify a second location on the fan to receive another balancing weight;

attaching another balancing weight to the plastic body at the second location; and spinning the fan again and terminating the balancing operation when the vibration sensor senses an amount of vibrations at or below a predetermined amount of vibrations.

12. A method of balancing an open fan having a plastic body and plastic fan blades rotatable about a central rotational axis, the method comprising:

spinning the fan about its rotational axis and sensing vibrations from the spinning fan;

stopping rotation of the fan;

specifying a location on the plastic fan body to receive a weight clip;

attaching the weight clip to the plastic body at the specified location to balance the fan; and the attaching of the weight clips to the plastic body comprising a pushing by integral barbs on metal weight clips into the plastic body with the barbs resisting throwing-off of the clips at high rotational speeds of the fan.

13. A method of balancing an open fan having a plastic body and plastic fan blades rotatable about a central rotational axis, the method comprising:

spinning the fan about its rotational axis and sensing vibrations from the spinning fan;

stopping rotation of the fan;

specifying a location on the plastic fan body to receive a weight clip;

attaching the weight clip to the plastic body at the specified location to balance the fan;

the attaching of the weight clips to the plastic body comprising:

providing a circular array of integral molded ribs on the plastic body; and securing channel-shaped clips over the ribs located at the specified locations on the plastic fan body.

14. A method of balancing an open fan in accordance with claim 13, wherein the securing channel-shaped clips over selected ribs comprise:

forcing integral barbs on the clips into the plastic ribs to secure the clips to the ribs; and snugly fitting the channel-shaped body against the mating surfaces on the ribs.

15. A method of balancing an open fan having a plastic body and plastic fan blades rotatable about a central rotational axis, the method comprising:

spinning the fan about its rotational axis and sensing vibrations from the spinning fan;

stopping rotation of the fan;

specifying a location on the plastic fan body to receive a weight clip;

attaching the weight clip to the plastic body at the specified location to balance the fan;

providing a metal hub plate which is attached at the center of the plastic fan body for attachment to a fan clutch; and providing a uniform thickness coat of electrostatically applied paint on the metal hub plate to assist in balancing the fan and in resisting corrosion of the metal plate.

16. A method of making a corrosion-resistant fan blade assembly having a plastic body with integral plastic fan blades and with a central metal hub plate, the method comprising:

providing a metal hub plate for the fan blade assembly;

electrostatically spray painting the metal hub plate using electrical charges between the metal plate and sprayed paint particles to attract the paint particles to the metal plate to coat the same substantially uniformly on opposite sides of the metal hub plate;

placing the electrostatically painted metal hub plate in a mold; and molding in situ, the fan blade body and the metal hub plate and to form the fan blades of the fan blade assembly.

17. A method in accordance with claim 16 including a providing of a series of holes in the metal hub plate, and forcing liquid plastic into the series of holes during the molding of the fan blade body to cool and form plastic pieces interlocking the metal plate and plastic fan body.

18. An open fan blade assembly comprising:

a plastic fan body rotatable about a central axis through the fan body;

a plurality of integral fan blades on the plastic fan body for rotation about the central axis;

a metal hub plate molded, in situ, with the plastic fan body;

metal faces on opposite sides of the metal hub plate; and a uniform coating of electrostatically sprayed paint on the metal faces to resist corrosion and to assist in balancing the fan blade assembly for spinning.

19. A method of making an open fan blade assembly comprising:

adding an anti-ultraviolet additive to bulk plastic to be used to mold a fan blade body;

providing a metal hub plate for the fan blade assembly;

placing the metal hub plate in a plastic mold; and molding the bulk plastic having the anti-ultraviolet additive to mold the fan blade body, in situ, with the metal plate to provide a cured fan blade body having fan blades and having a resistance to deterioration by ultraviolet radiation.

20. An open fan blade assembly comprising:

a molded, plastic fan body rotatable about a central axis;

a plurality of integral fan blades on the plastic body for rotation about the central axis;

a metal hub plate molded, in situ, with the plastic fan body; and an anti-ultraviolet additive in the plastic of molded plastic fan body to resist ultraviolet radiation.

21. An open fan blade in accordance with claim 20 wherein the plastic comprises a nylon material; and glass particles filling the nylon material.

22. A balanced open fan for use with a fan clutch comprising:

a central metal hub plate having a central opening at a rotational axis for the fan to receive a portion of the fan clutch;

a plastic fan body molded, in situ, to the central metal plate;

the hub plate having openings therein to receive liquid plastic therein to unite the plastic fan blade body to the metal hub plate;

discrete, separated plastic fan blades each extending radially outwardly from an inner end which is integrally attached to the plastic fan body and which extends outwardly to rotate about the central axis;

an intermediate portion of the plastic fan body intermediate the fan blades and the metal hub plate configured to receive balancing weights therein; and balancing weights configured to match the configuration on the intermediate portion of the plastic body to assist in fastening the balancing weights to the plastic fan body, the balancing weights being attached at locations radially inward of the inner ends of the fan blades.

23. A balanced open fan for use with a fan clutch in accordance with claim 22 wherein the intermediate portion configured to receive balancing weights therein comprises ribs extending radially with grooves between adjacent ribs.

24. A balanced open fan for use with a fan clutch in accordance with claim 22 wherein the balancing weights are clips that are configured to clip onto the configured intermediate portion of the plastic fan body.

* * * * *